United States Patent [19]

Mitsch et al.

[11] Patent Number: 4,972,166

[45] Date of Patent: Nov. 20, 1990

[54] ELECTROMAGNETIC RELAY

[75] Inventors: Manfred Mitsch, Ansbach; Theodor Sturm, Sachsen; Karl Brandsch, Stein; Volker Busch, Oberasbach; Anton Frenznick, Nürnberg, all of Fed. Rep. of Germany

[73] Assignee: Robert Bosch GmbH, Stuttgart, Fed. Rep. of Germany

[21] Appl. No.: 417,256

[22] Filed: Oct. 5, 1989

[30] Foreign Application Priority Data

Oct. 22, 1988 [DE] Fed. Rep. of Germany ..... 3836096

[51] Int. Cl.[5] ..... H01H 67/02

[52] U.S. Cl. ..... 335/128; 335/273; 335/86

[58] Field of Search ..... 335/78–86, 335/120, 124, 128, 230, 273

[56] References Cited

FOREIGN PATENT DOCUMENTS 2832507 7/1973 Fed. Rep. of Germany .
3423270 6/1984 Fed. Rep. of Germany .
3640997 12/1986 Fed. Rep. of Germany .

*Primary Examiner*—Leo P. Picard
*Assistant Examiner*—Lincoln Donovan
*Attorney, Agent, or Firm*—Michael J. Striker

[57] ABSTRACT

An electromagnetic relay has a base plate, a magnetic yoke mounted on the base plate, a relay winding, a spool core supporting the relay winding, a hinged armature arranged turnably on the spool core, a switching contact supported on the hinged armature, a counter contact cooperating with the switching contact, an adjusting part adjusting a contact distance between the countercontact and the switching contact when the armature is retracted and having at least one stretching zone extending substantially in a movement direction of the armature, the adjusting part forming a lever having a free end cooperating with the switching contact and another end anchored on the base plate, and an adjusting web provided with the stretching zone and engaging at a location between the ends with the adjusting part, so that by extension of the adjusting web to adjust the contact distance at the free end of the adjusting part.

16 Claims, 1 Drawing Sheet

ELECTROMAGNETIC RELAY

BACKGROUND OF THE INVENTION

The present invention deals with an electromagnetic relay. More particularly, it deals with a relay which has a base plate, a magnet yoke with a relay winding on a spool core and also with hinged armature having a switching contact cooperating with fixed countercontacts.

Electromagnetic relays of the above-mentioned general type are known in the art. One of such relays is disclosed, for example, in the German document DE 2,832,507 C2. In this electromagnetic relay for adjusting the stationary relay contact the contact support is provided with three parallel legs and a common connecting yoke, wherein the central leg carries the rest contact. By lateral squeezing in a so-called stretching zone of the leg, the relay contact is adjusted in its position to the switching contact mounted on the hinged armature.

In the construction disclosed in this reference, a relative wide space is required for adjusting the contact by the respective design of the contact support in the movement direction of the hinged armature. This space is, however, frequently not available in flat relay constructions, especially taking into consideration that the whole adjusting path of the relay contact must be provided by a respective long stretching of the central contact support leg. This also requires relatively great sizes in the case of either a relay switch correspondingly longer adjusting path. Such sizes are however limited by standardized outer dimensions of the relay housings and plug pattern. Further, it is also known from the German document DE 2,832,507 C2 that for adjusting of the relay contact, the position of the hinged armature with a retracted relay can be adjusted by automatic wobble rivering of the armature-size spool core end. This is however time consuming and inaccurate, especially when the switching contact cooperates with the rest or working contacts of the relay. It is proposed in DE-GM 7,407,510 to adjust the contacts after the assembly of the relay parts by hand by bending the contact support or contact tongues. This is also inaccurate and moreover time consuming and costly.

Finally, the German document DE 3,434,270 A1 discloses a relay in which on the working contact by its accurate positioning, the contact pressure and the waste reserve is adjusted with pull-in armature. The contact distance of the switching contacts from the working contact with a retracted armature is adjusted by a stemp adjusting of the rest contact located underneath. The rest contact forms here an abutment for the relay contact which, due to the very limited stretching zone provides only a short adjusting path.

SUMMARY OF THE INVENTION

Accordingly, it is an object of the present invention to provide a relay with narrow bounding dimensions by an accurate, fast, reliable stemp adjustment with long adjusting path for adjusting the contact distance In keeping with these objects and with others which will become apparent hereinafter, one feature of the present invention resides, briefly stated, in an electromagnetic relay of the above mentioned general type, in which the adjusting part which adjusts the contact distance forms a lever with a free end cooperating with the switching contact of the hinged armature and another end anchored on the base plate, and an adjusting web with a stretching zone engages with the adjusting part at a location between the above two ends for adjusting during stretching of the adjusting web the contact discs at the free end of the adjusting part.

When the electromagnetic relay is designed in accordance with the above specified novel features of the present invention, the adjusting part is formed as a one-side clamped lever engaged by an adjusting web between a free lever end functioning as an abutment and an anchoring point of the adjusting part with the base plate. Thereby the adjusting path for the contact distance can be increased by the lever action of the adjusting web so that with a smaller stretching of the adjusting web in the stretching zone, the adjustment of the contact distance is possible also in the event of big voltage relays in a narrow space. A further advantage of the present invention is the dimension of the adjusting part in the movement region of the switching contact at the relay armature can be maintained within the outer dimensions of the relay dictated by respective standards. Moreover, in this manner a reliable, accurate, fast and cost-favorable adjustment is provided.

In accordance with another feature of the present invention it is especially advantageous when the adjusting lever is bent to form a U-shaped or V-shaped abutment bracket for the switching contact of the relay in the event of retracted armature, and the adjusting web with the stretching zone is arranged between two legs of the abutment bracket.

Advantageously, the adjusting web is punched from one of the legs of the abutment bracket and bent toward the other leg.

For avoiding lateral sliding of the adjusting web against the leg of the abutment bracket during the adjusting process, the adjusting web in an advantageous manner can be provided with a projection on its free end, which projection engages in a respective recess on the leg of the abutment bracket.

For facilitating the adjusting process, the abutment bracket in its U-shaped or V-shaped bent region is provided with an intended bending location The latter can be formed as a whole in a contact support.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
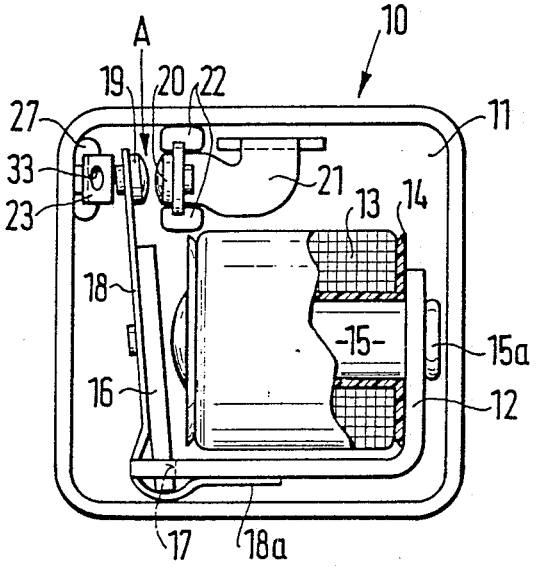
FIG. 1 is a view showing an electromagnetic relay in accordance with the present invention without housing and on an increased scale, from below.

A relay for power vehicles in accordance with the present invention is shown in FIG. 1 and identified as a whole by reference numeral 10. It has a base plate 11 composed of an isolating material. A plurality of plug contacts which form the terminals of the relay 10 are mounted on the base plate 11. They project outwardly beyond the rear side of the base plate 11 which is not shown in the drawings.

The base plate further carries an L-shaped magnet yoke 12. The latter is anchored at the end side with mounting tongues in respective pockets of the base plate 11. A relay winding 13 is wound on a spool frame 14 displaceable on a spool core 15. The spool core 15 is connected with its rear end 15*a* to the short leg of the magnet yoke 12 by riveting.

Hinged armature 16 is located before the front end of the spool core 15. It is turnably supported in a recess 17 provided on the long leg of the magnet yoke 12 and shown in a dotted line. A contact spring 18 is mounted by riveting on the hinged armature 16. The rear bent end 18*a* of the contact spring 18 is connected with the magnet yoke 12 by point welding. The front end of the contact spring 18 carries a switching contact 19 which cooperates with a stationary countercontact 20. The Countercontact 20 is mounted by riveting on a contact support 21. The contact support is received in a guide 22 formed on the base plate 11 and leads to a not shown block contact.

Figure 2:
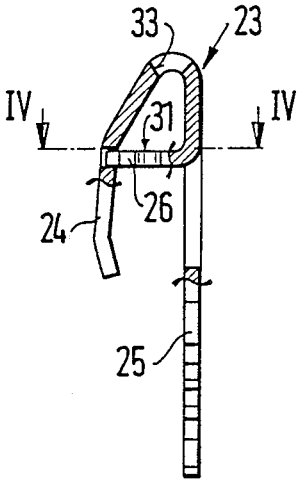
FIG. 2 shows an abutment bracket for a switching contact of the inventive electromagnetic relay, as an adjusting part for the contact distance, on a considerably enlarged scale.

An abutment bracket 23 is provided for adjusting the contact distance A between the switching contact 19 and the countercontact 20 functioning as a working contact of the relay 10. The switching contact 19 abuts against the abutment brackets 23 in the event of the retracted armature 16. As can be seen from FIGS. 2 and 3, the abutment bracket 23 forms an adjusting part which is bent so as to assume a U-shaped or V-shaped profile. An adjusting web 26 is provided between both legs 24 and 25 of the abutment bracket 23. The longer leg 25 is received in the guides 27 of the base plate 11 and sinks in the material of the base plate in form-locking manner by lateral toothing 28. The adjusting web 26 is punched from the leg 25 of the abutment bracket 23 which is anchored in the base plate 11. It is bent perpendicularly to the other leg 24 of the abutment bracket 23, so that the leg 24 abuts on the free end of the web 26.

Figure 4:
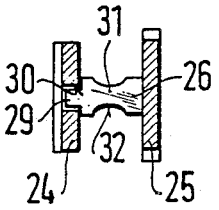
FIG. 4 showing an abutment bracket in cross-section taken along the line IV—IV in FIG. 2.

As shown in FIG. 4, the adjusting web 26 has at its free end a shaped projection 29 which engages in a respective recess 30 of the leg 24 of the abutment bracket 23 and prevents a lateral sliding of the adjusting web on the leg 24. The adjusting web 26 has in its central part a stretching zone 31 in which the adjusting web 26 is expanded for adjusting the contact distance A of the relay 10, by two-side squeezing 33 with a not shown stemp dye in the movement direction of the armature 16 or in the longitudinal direction of the spool core 15. The abutment bracket 23 forms a lever with its leg 24 abutting against the switching contact 19. The free end 24*a*' of the lever cooperates with the switching contact 19 of the hinged armature 16. The opposite end of the hinged armature 16 is anchored by the lower leg 24 on the base plate 11, and on it during expansion of the engaging adjusting web 26 the contact distance A is adjusted by the lever action at the free end of the leg 24. With the not shown stemping dye, the both-sided squeezing 32 in the expansion zone 31 of the adjusting web 26 can be so dosed in its width and depth and therefore the adjusting web 26 can be so extended, until through the lever action of the leg 24 the switching contact 19 abuts against the free end 24*a* of the abutment bracket 23 assumes the desired contact distance A relative to the countercontact 20. The bending of the free leg end 24*a* abutting against the switching contact 19 is facilitated by a positive bending location in the U-shaped or V-shaped bent region 23*a* of the abutment bracket 23, by punching a hole 33 in the abutment bracket 23.

Figure 3:
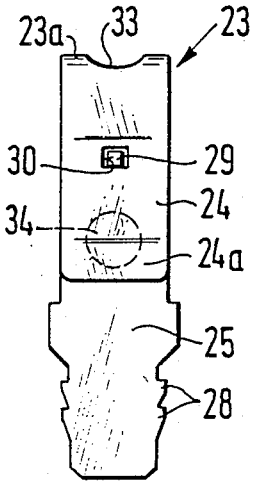
FIG. 3 shows the same abutment bracket, but turned by 90°.

The present invention is not limited to the specific example described hereinabove. The principle of the solution can be used in other relay constructions as well. Within the limits of the present invention it is possible to arrange an rest contact 34 on the free end 24*a* of the abutment bracket 23 as shown in FIG. 3 in a broken line. The rest contact 34 cooperates with the switching contact 19 in the retracted condition of the relay. It is however also possible to arrange the working contact with the relay on the free end of the lever-like contact support. Its other end is anchored on the base plate, and an adjusting web is arranged on its between these ends with a stretching zone extending in the movement direction of the armature. Thereby during stretching of the adjusting web the contact distance with the retracting armature or the contact pressure with attracted armature is adjusted. It is also possible in accordance with the present invention that during stretching of the adjusting web in its stretching zone, a lever action occurs on the adjusting part adjusted in correspondence with the contact distance, while increasing the adjusting path.

It will be understood that each of the elements described above, or two or more together, may also find a useful application in other types of constructions differing from the types described above.

While the invention has been illustrated and described as embodied in an electromagnetic relay, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said abutment bracket being formed as a U-shaped element.

2. An electromagnetic relay as defined in claim 1, wherein said base plate is composed of an isolating material.

3. An electromagnetic relay as defined in claim 1, wherein said hinged armature is arranged on an end side of said spool core.

4. An electromagnetic relay as defined in claim 1, wherein said countercontact has a contact support mounted on said base plate.

5. An electromagnetic relay as defined in claim 1, wherein said adjusting part is formed as a bent abutment bracket with a free leg and an immovable leg mounted on said base plate, said adjusting web with said stretching zone being arranged between said legs of said abutment bracket.

6. An electromagnetic relay as defined in claim 2, wherein said free leg of said abutment bracket has a recess, said adjusting web having a free end provided with a projection which engages said recess.

7. An electromagnetic relay as defined in claim 1, wherein said adjusting web is stretched in its stretching zone by both sides squeezing so that by a lever action of said adjusting part the switching contact abuts at a free end of said adjusting part and provides a desired contact distance from said countercontact.

8. An electromagnetic relay as defined in claim 1, wherein said adjusting part has a free end which carries said countercontact.

9. An electromagnetic relay as defined in claim 8, wherein said countercontact is formed as a rest contact.

10. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said abutment bracket being formed as a V-shaped element.

11. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said base plate being composed of an isolating material, said adjusting web with said stretching zone being stamped from one of said legs of said abutment bracket and bent toward the other of said legs so far that said other leg abuts against a free end of said adjusting web.

12. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said adjusting web being stamped from said immovable leg mounted on said base plate and is bent up perpendicularly to said free leg.

13. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said adjusting part being formed as a bent abutment bracket with a free leg and an immovable leg mounted on said base plate, said adjusting web with said stretching zone being arranged between said legs of said abutment bracket, said abutment bracket having a bent region provided with a point of intended bending.

14. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said adjusting part being formed as a bent abutment bracket with a free leg and an immovable leg mounted on said base plate, said adjusting web with said stretching zone being arranged between said legs of said abutment bracket.

15. An electromagnetic relay, having a base plate; a magnetic yoke mounted on said base plate; a relay winding; a spool core supporting said relay winding; a hinged armature arranged turnably on said spool core; a switching contact supported on said hinged armature; a counter contact cooperating with said switching contact; an adjusting part adjusting a contact distance between said countercontact and said switching contact when said armature is retracted and having at least one stretching zone extending substantially in a movement direction of said armature, said adjusting part forming a lever having a free end cooperating with said switching contact and another end anchored on said base plate; and an adjusting web provided with said stretching zone and engaging at a location between said ends with said adjusting part, so as by extension of said adjusting web to adjust the contact distance at said free end of said adjusting part, said free leg of said abutment bracket having a recess, said adjusting web having a free end provided with a projection which engages said recess.

16. An electromagnetic relay as defined in claim 13, wherein said point of intended bending is formed as a hole provided in said abutment bracket.

* * * * *